US006608545B2

(12) United States Patent
Fricker et al.

(10) Patent No.: US 6,608,545 B2
(45) Date of Patent: Aug. 19, 2003

(54) PLANAR TRANSFORMER

(75) Inventors: Ronald Kevin Fricker, Pretoria (ZA); Marthinus Christoffel Smit, Pretoria (ZA); Herman Allison, Pretoria (ZA)

(73) Assignee: Nucleus Ecopower Limited, Jersey (GB)

( * ) Notice: Subject to any disclaimer, the term of this patent is extended or adjusted under 35 U.S.C. 154(b) by 0 days.

(21) Appl. No.: 09/936,636

(22) PCT Filed: Jan. 22, 2001

(86) PCT No.: PCT/IB01/00065

§ 371 (c)(1),
(2), (4) Date: Sep. 12, 2001

(87) PCT Pub. No.: WO01/54149

PCT Pub. Date: Jul. 26, 2001

(65) Prior Publication Data

US 2003/0067377 A1 Apr. 10, 2003

(30) Foreign Application Priority Data

Jan. 24, 2000 (ZA) ..... 2000/0300

(51) Int. Cl.[7] ..... H01F 5/00
(52) U.S. Cl. ..... 336/200; 336/223; 336/232
(58) Field of Search ..... 336/200, 223, 336/232

(56) References Cited

U.S. PATENT DOCUMENTS

| | | | | |
|---|---|---|---|---|
| 4,937,729 A | | 6/1990 | Gadreau et al. | |
| 5,631,822 A | * | 5/1997 | Silberkleit et al. | 363/144 |
| 5,781,071 A | * | 7/1998 | Kusunoki | 330/269 |
| 5,781,093 A | | 7/1998 | Grandmont et al. | |
| 5,877,667 A | * | 3/1999 | Wollesen | 336/200 |
| 6,281,779 B1 | * | 8/2001 | Matsumoto et al. | 336/200 |
| 6,339,320 B1 | * | 1/2002 | Spremo et al. | 323/355 |

FOREIGN PATENT DOCUMENTS

GB 2 084 809 4/1982

* cited by examiner

*Primary Examiner*—Anh Mai
(74) *Attorney, Agent, or Firm*—Blakely, Sokoloff, Taylor & Zafman LLP

(57) ABSTRACT

This invention relates to a planar transformer which includes a primary winding and a secondary winding defined by a first stage including at least one track on a first layer and at least one track on a second layer. These in combination provide a first output voltage. The transformer also includes a second stage which includes at least one track on the first layer and at least one track on the second layer which in combination provide a second output voltage. Furthermore, the ratio of the maximum cumulative current in the first and second stages is equal to half of the ratio of the track widths of the first and second stages. The invention extends to a method of enhancing electrical or physical characteristics of a planar transformer.

9 Claims, 3 Drawing Sheets

PLANAR TRANSFORMER

CROSS REFERENCE TO RELATED APPLICATIONS

This application claims the benefit of PCT Patent Application No. PCT/IB01/00065, filed on Jan. 22, 2001, which claims priority from South African Patent Application No. ZA 2000/0300, filed Jan. 24, 2000.

FIELD OF THE INVENTION

THIS INVENTION relates to a planar transformer. It also relates to a method of optimizing a planar transformer.

BACKGROUND OF THE INVENTION

With the advent of new technology there is a constant drive to make products which are more compact. In certain electronic equipment the power supply with its associated transformer occupies a relative large volume, particularly where relatively high power is to be delivered with multiple output voltages. Reducing the physical size of the transformer may thus be advantageous.

BRIEF SUMMARY OF THE INVENTION

According to a first aspect of the invention, there is provided planar transformer which includes a primary winding; and a secondary winding defined by a first stage including at least one track on a first layer and at least one track on a second layer which in combination provide a first output voltage, and a second stage including at least one track on the first layer and at least one track on the second layer which in combination provide a second output voltage, wherein the ratio of maximum cumulative current in the first and second stages is equal to half of the ratio of the track widths of the first and second stages.

The first stage may include at least one track on the first layer and at least one track on the second layer each for opposite output current and the second stage may include at least a pair of tracks, one on each layer, each for opposite output current.

The tracks associated with the first stage may be connected in series with the tracks associated with the second stage and the voltage across the first stage may form part of the voltage of the second stage.

A single pass of a track through a core of the transformer may provide a segment voltage and the segments may be connected in series to form at least one string of voltage segments with voltage output tapping points.

The tracks and their associated segments are typically printed circuit board tracks similar to those used in conventional planar transformers.

The transformer may include at least two voltage strings which start at the same point and pass through the core of the transformer in opposite directions so that the voltage strings are mirror images of each other thereby to balance the core.

The two voltage strings may provide voltage tapping points having opposite polarities.

The planar transformer may include at least one source of flux generated by at least one primary winding connected in a series or parallel configuration.

The first stage may be configured to provide an output voltage of about 3.4 V from the tracks of the first stage, and the second stage may be configured to provide an output voltage of about 5.1 V from the tracks of the first stage together with the tracks of the second stage.

The planar transformer may include at least one further output voltage stage.

According to another aspect of the invention, there is provided a planar transformer which includes a primary winding; and a secondary winding defined by at least two tracks, wherein the ratio of maximum cumulative current in the tracks is equal to half of the ratio of the track widths.

According to a further aspect of the invention, there is provided a method of enhancing electrical or physical characteristics of a planar transformer, the method including designing a primary winding which is capable of inducing a preselected minimum voltage in a secondary winding of the transformer; and designing the secondary winding so that it includes first and second tracks, wherein the ratio of maximum cumulative current in the first and second tracks is equal to half of the ratio of the track widths of the first and second tracks.

According to yet a further aspect of the invention, there is provided a method of enhancing electrical or physical characteristics of a planar transformer, the method including designing a primary winding which is capable of inducing a preselected minimum voltage in a secondary winding of the transformer; and designing a secondary winding so that it includes a first stage including a first track on a first layer and a second track on a second layer which in combination provide a first output voltage, and a second stage including a third track and fourth track on the first layer and a fifth track and sixth track on the second layer which in combination provide a second output voltage, wherein the ratio of maximum cumulative current in the first and second stages is equal to half of the ratio of the track widths of the first and second stages.

Conventional planar transformers which have E-type cores are manufactured in standard sizes. Thus the present invention may be used to optimize the electrical or physical characteristics of a planar transformer which uses a standard core.

In a preferred embodiment of the invention, the planar transformer is configured for use in computer equipment such as a personal computer or PC. Accordingly, the first stage may be configured to provide an output voltage of about 3.4 V from two single turns which each pass through the core once, and the second stage may be configured to provide an output voltage of about 5.1 V from three single turns i.e. a further single turn connected in series to the two single turns of the first stage. In a similar fashion, the transformer may also include further stages, e.g. a third stage to provide about 11.9 V.

The invention is now described, by way of example, with reference to the accompanying diagrammatic drawings.

DETAILED DESCRIPTION OF THE DRAWINGS

Figure 1:
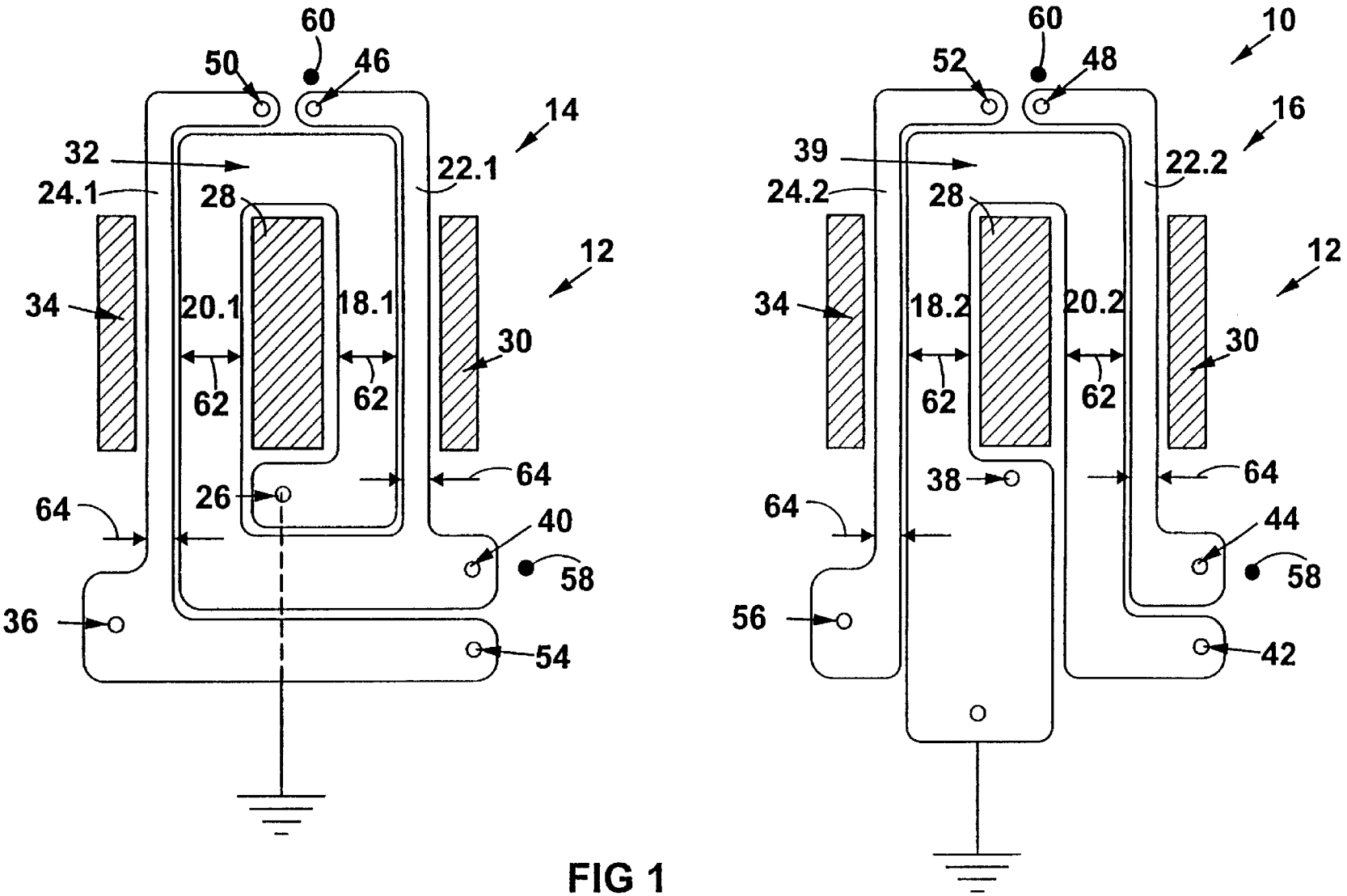
FIG. 1 shows a schematic view of first and second layers of a planar transformer in accordance with the invention.
Figure 2:
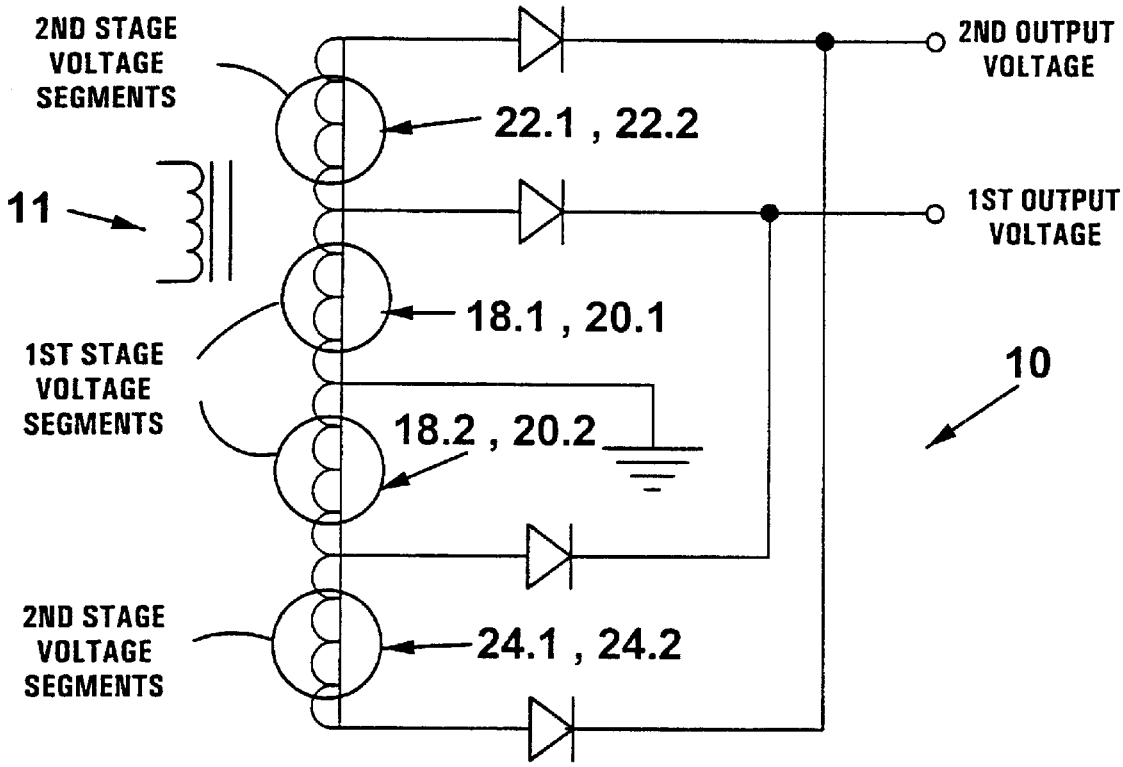
FIG. 2 shows a schematic representation of an equivalent circuit of the planar transformer of FIG. 1.

Referring in particular to FIGS. 1 and 2 of the drawings, reference numeral 10 generally indicates a planar transformer in accordance with the invention. The transformer 10 includes a conventional primary winding 11 (shown in FIG. 2 only), a conventional E-type core 12, and a secondary winding comprising a first layer 14 and a second layer 16. As described in more detail below, track widths of the secondary winding are configured so that the ratio of the maximum cumulative current in first and second stages of the secondary winding is equal to about half the ratio of the track widths of the first stage to the track widths of the second stage thereby to enhance, and preferably optimize, the electrical characteristics of the transformer 10.

Figure 3:
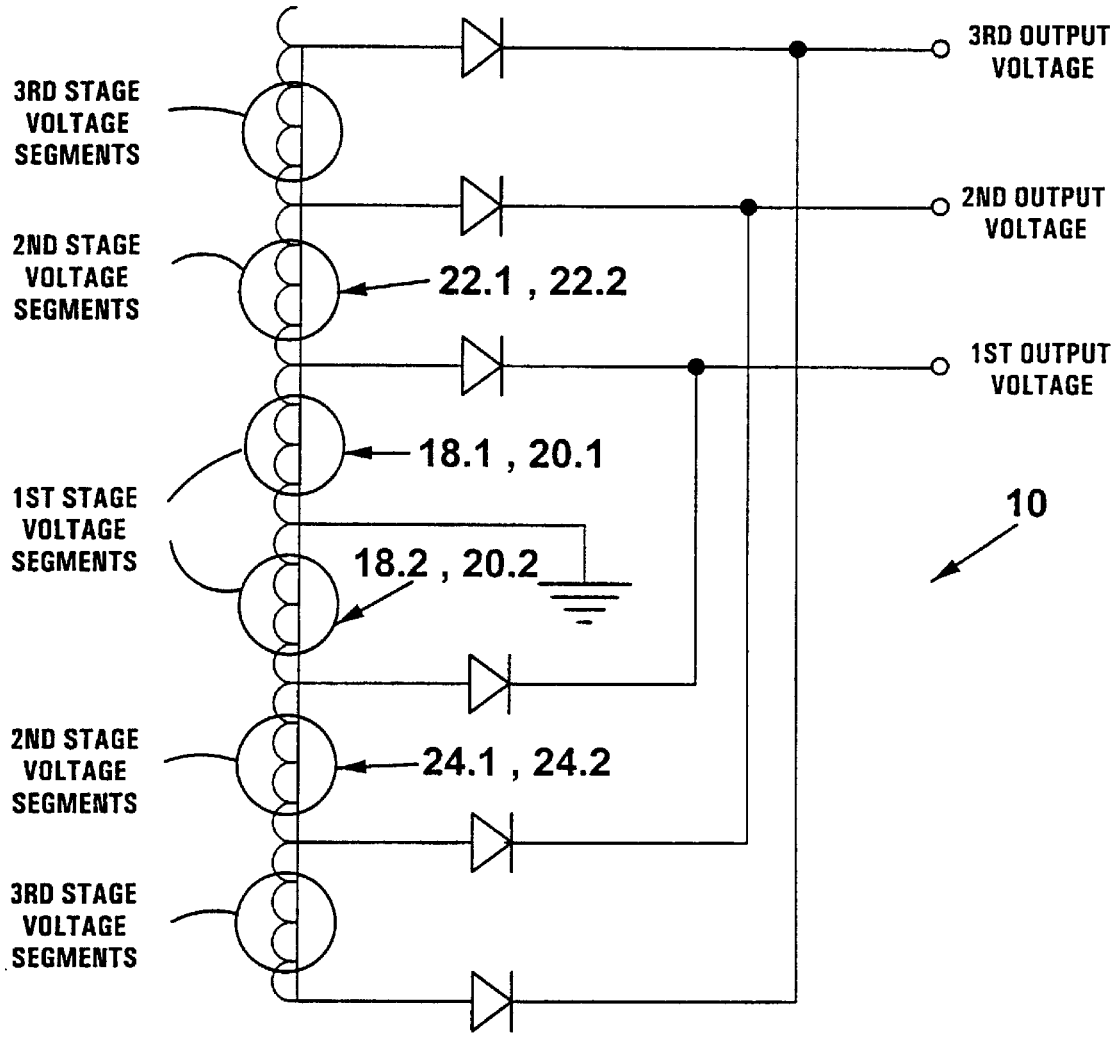
FIG. 3 shows a schematic circuit diagram of an equivalent circuit of a further embodiment of the transformer which includes additional segments to provide a further output voltage.

The transformer 10 is arranged to be suitable for use in a power supply of a personal computer or PC. Accordingly, the secondary winding is arranged (e.g. shaped and dimensioned) to provide a first output voltage of about 3.4 V and a second output voltage of about 5.1 V. The first and second output voltages are then regulated in a conventional manner to provide a regulated 3.3 V output and a regulated 5.0 V output for use in electronic circuitry of the PC. In the embodiment depicted in FIG. 3 of the drawings, a further third voltage output of 11.9 V, which is regulated in a conventional manner to about 12 V, is provided.

The primary and secondary windings are defined on printed circuit boards in a similar fashion to conventional planar transformers. The primary winding 11 is arranged so that sufficient flux is generated by the winding to induce a segment voltage of about 1.7 V, as described in more detail below. The secondary winding includes a plurality of segments 18.1 and 18.2, 20.1 and 20.2, 22.1 and 22.2, and 24.1 and 24.2 provided respectively on the first layer 14 and the second layer 16. Each segment 18 to 24 makes a single pass through the core 12 of the transformer 10. The segments 18.1, 20.1, 22.1 and 22.2 are connected to provide a voltage string. Likewise, the segments 18.2, 20.2, 24.1, and 24.2 are also connected to provide a voltage string.

As shown in FIG. 1 of the drawings, the segments 18.1, 20.1, 22.1, and 24.1 are provided on the first layer 14 and the segments 18.2, 20.2, 22.2, and 24.2 are provided on the second layer 16. The interconnection and physical layout of the segments 18.1–24.1 and 18.2–24.2 is arranged so that they are mirror images of each other in order to balance the core 12. In combination, they provide pairs of opposite voltage polarity tapping points, as described in more detail below, which are typically connected in a half-bridge arrangement as shown in FIG. 2 of the drawings.

As mentioned above, the primary winding 11 of the transformer 10 generates sufficient flux so that the voltage induced in each segment 18 to 24 is about 1.7 V. The voltage segment 18.1 of the first layer 14 starts at contact point 26 and spirals out in a counter-clockwise direction between a central leg 28 and a side leg 30 terminating at 32 where it is connected to the segment 20.1. The segment 20.1 extends between the central leg 28 and a side leg 34 of the core 12 and terminates at a contact point 40. In a similar fashion but in an opposed clockwise direction, the segment 18.2 extends from a contact point 38 between the legs 34 and 28 of the transformer 10 terminating at 39 where it is connected to the segment 20.2. The segment 20.2 extends from 39 between the legs 28 and 30 and terminates at contact point 42. The segments 18.1, 20.1 and 18.2, 20.2 define a first stage of the transformer 10 which provides an output voltage of two times 1.7 V, i.e. 3.4 V, as two segments are connected in series.

In order to provide an additional 1.7 V output, which in combination with the 3.4 V output of the first stage provides a 5.1 V output, a second stage which is defined by the segments 22.1, 24.1 and 22.2, 24.2 are provided respectively on the first and second layers 14, 16 of the transformer 10. The segments 22.1, 24.1 and 22.2, 24.2 define third and fourth tracks respectively. The segments 22.1 and 22.2 are associated and are connected in parallel and the segments 24.1 and 24.2 are also associated and connected in parallel thereby to enhance the current carrying capabilities of the second stage. In order to connect the first and second tracks in the appropriate series/parallel configuration as described above, the contact points 26 and 38, 40 and 44, 46 and 48, 50 and 52, 54 and 42 and 36 and 56 are electrically connected across the first and second layers 14, 16.

The second stage (which provides the 5.1 V output at the contact points 46, 48 and 50, 52) is defined by two parallel extensions defined by the segments 22.1, 22.2, and 24.1, 24.2 which are connected in series with the first stage (which provides a 3.4 V output at the contact points 40, 44 and 54, 42). In the embodiment depicted in the drawings, it is important that the tracks be designed so that the current distribution in the segment 22.1 and the segment 18.1 share the same core window width i.e. they pass between the legs 28 and 30 of the core 12 on a single layer which, in this case, is the first layer 14. Further, the segments 22.2 and 20.2 share the same core window width (i.e. they pass between legs 28 and 30) on the second layer 16. In a similar fashion, the segments 24.1 and 20.1 share the same core window width (i.e. they both pass between legs 34 and 28) on the first layer 14 while the segments 24.2 and 18.2 share the same core window width (i.e. they pass between legs 34 and 28 of the core 12 on the second layer 16).

Using the dot convention, the positive polarity of the transformer 10 is assigned to the output defined at contact points 40, 44 of the 3.4 V stage as shown by dots 58 and, in respect of the 5.1 V output stage, dots 60. Accordingly, for the positive generation cycle according to the dot convention, a single first stage track defined by segment 18.1 shares the core window width defined between the legs 28 and 30 with the two tracks formed by the segments 22.1 and 22.2, the latter of which are responsible for the second stage voltage i.e. the 5.1 V output. Similarly, for the negative generation cycle, a single first stage track defined by the segment 18.1 shares the core window width with two tracks defined by the segments 22.1 and 22.2 which, are also responsible for the second stage voltage.

As mentioned above, the first stage providing the 3.4 V output is defined on the first layer 14 by the segments 18.1 and 20.1 and on the second layer 16 by the segments 18.2 and 20.2. The second stage output which, in combination with the first stage output, provides a 5.1 V output is defined by the segments 22.1, 24.1 and 22.2, 24.2 which are provided on the first and second layers 14, 16 respectively. In order electrically to optimize the transformer 10, the track widths, and therefore the current carrying capabilities, of the first and second stages are proportional to the maximum cumulative current in the tracks of each stage i.e. the single track on the first layer 14 defined by segments 18.1 and 20.1 for the first stage and the two parallel tracks defined by segments 22.1, 22.2 and segments 24.1 and 24.2 for the second stage.

The relationship between the maximum cumulative current and the track widths may be defined as follows:

$$\frac{\text{First stage individual track width}}{2\times\text{second stage individual track width}} = \frac{\text{Max. cumulative current in first stage}}{\text{Max. cumulative current in second stage}}$$

wherein, the first stage individual track width is shown by arrows 62 and the second stage individual track width is shown by arrows 64.

It is however to be appreciated that any configuration and number of voltage stages may be included (see FIG. 3) before or after the set of voltage stages described above.

It is believed that, as the first and second layers 14, 16 have all the tracks necessary to complete two voltage stages and a proportional relationship governs the distribution of the track widths such that the entire core window width is utilised, the design of the transformer 10 is enhanced. In view of the aforementioned, the current density of the tracks, which thus also obeys the proportional relationship, is equally distributed when all outputs are delivering a maximum current, for example, in a worst case scenario. In order to achieve this, the second voltage stage comprises a parallel arrangement of the segments 22.1, 22.2, 24.1 and 24.2. The segments 18.1, 20.1, 18.2, 20.2, 22.1, 22.2, 24.1 and 24.2 define a complementary pair which are duplicated to increase the current carrying capability.

In certain embodiments of the invention where the available track widths of part of the secondary voltage string are not sufficient, surface mount plates, e.g. Cu plates or the like, may be used to reduce resistance. Further, cooling fins may be provided to enhance heat dissipation.

It is believed that the invention, as illustrated, provides an enhanced planar transformer 10 in which the number of PC board layers are kept to a minimum. Further, maximum use of the core window width is utilised for current carrying tracks and the minimum number of passes through the core windows allow maximum track width and therefore maximum cross-sectional area which, in turn, reduces the current density and optimises efficiency of the magnetic coupling. Due to the ratio of the track widths, maximum current density is uniformly distributed amongst the tracks thereby enhancing performance of the transformer 10. The enclosed area in the loop between pairs of output polarities for each voltage and to ground is kept to a minimum thereby to ensure low leakage inductance and enhanced regulation. Further, as the opposite polarities for each voltage are brought closer together, conduction losses are reduced and rectification circuit design is simplified.

What is claimed is:

1. A planar transformer which includes a primary winding; and a secondary winding defined by a first stage including at least one track on a first layer and at least one track on a second layer which in combination provide a first output voltage, and a second stage including at least one track on the first layer and at least one track on the second layer which in combination provide a second output voltage, wherein the ratio of maximum cumulative current in the first and second stages is equal to half of the ratio of the track widths of the first and second stages.

2. A planar transformer as claimed in claim 1, in which the first stage includes at least one track on the first layer and at least one track on the second layer each for opposite output current and in which the second stage includes at least a pair of tracks, one on each layer, each for opposite output current.

3. A planar transformer as claimed in claim 1, in which the tracks associated with the first stage are connected in series with the tracks associated with the second stage and in which the voltage across the first stage forms part of the voltage of the second stage.

4. A planar transformer as claimed in claim 1, in which a single pass of a track through a core of the transformer defines a segment with a segment voltage and in which the segments are connected in series to form at least one string of voltage segments with voltage output tapping points.

5. A planar transformer as claimed in claim 4, which includes at least two voltage strings which start at the same point and pass through the core of the transformer in opposite directions so that the voltage strings are mirror images of each other thereby to balance the core.

6. A planar transformer as claimed in claim 5, in which the two voltage strings provide voltage tapping points having opposite polarities.

7. A planar transformer as claimed in claim 1, in which the first stage is configured to provide an output voltage of about 3.4 V from the tracks of the first stage, and in which the second stage is configured to provide an output voltage of about 5.1 V from the tracks of the first stage together with the tracks of the second stage.

8. A planar transformer as claimed in claim 1, which includes at least one further output voltage stage.

9. A method of enhancing electrical or physical characteristics of a planar transformer, the method including designing a primary winding which is capable of inducing a preselected minimum voltage in a secondary winding of the transformer; and designing a secondary winding so that it includes a first stage including a first track on a first layer and a second track on a second layer which in combination provide a first output voltage, and a second stage including a third track and fourth track on the first layer and a fifth track and sixth track on the second layer which in combination provide a second output voltage, wherein the ratio of maximum cumulative current in the first and second stages is equal to half of the ratio of the track widths of the first and second stages.

* * * * *